US006371288B1

(12) United States Patent
Licata

(10) Patent No.: US 6,371,288 B1
(45) Date of Patent: Apr. 16, 2002

(54) STUDENT TRAVELING KIT

(76) Inventor: Rachel Massey Licata, 6 Edelweiss La., Voorhees, NJ (US) 08043

( * ) Notice: Subject to any disclaimer, the term of this patent is extended or adjusted under 35 U.S.C. 154(b) by 0 days.

(21) Appl. No.: 09/616,813

(22) Filed: Jul. 13, 2000

(51) Int. Cl.[7] ..... A45C 3/02

(52) U.S. Cl. ..... 206/214; 108/14; 190/11; 190/109; 206/542; 206/579

(58) Field of Search ..... D3/292, 319; 108/14, 108/43; 190/11, 109–111, 117; 206/214, 215, 223, 224, 320, 371, 315.1, 457, 541, 542, 549, 579; 312/231

(56) References Cited

U.S. PATENT DOCUMENTS 1,147,077 A * 7/1915 Collier ..... 190/11
1,274,003 A * 7/1918 Christie ..... 190/111
2,211,660 A * 8/1940 Kidd et al. ..... 190/11
3,112,017 A * 11/1963 Lifton ..... 190/109
3,347,346 A * 10/1967 Young ..... 190/110
3,891,070 A * 6/1975 Montanari ..... 190/117
D249,184 S * 8/1978 Hargrove ..... D3/292
4,106,597 A * 8/1978 Shook et al. ..... 190/110
D300,987 S * 5/1989 Gerch ..... D3/319

* cited by examiner

*Primary Examiner*—Jim Foster
(74) *Attorney, Agent, or Firm*—Licata & Tyrrell P.C.

(57) ABSTRACT

My invention is a Student Traveling Kit. The kit is made up of a sturdy carrying case, divided into special compartments and including a lightweight plastic desk top. The kit is also decorated so it can be easily identified.

1 Claim, 2 Drawing Sheets

STUDENT TRAVELING KIT

FIELD OF THE INVENTION

The present invention is a Student Traveling Kit which allows a student on a trip to do their homework, play games, have snacks and keep neat. The kit comprises a carrying case with compartments for student necessities and a desk top. The carrying case must be sturdy and of a size to provide for a number of compartments and to provide a desk for the student.

BACKGROUND OF THE INVENTION

When I went to Italy, I took my backpack. I put my homework, games, snacks and my personal items such as my brush, toothbrush and toothpaste in my backpack. I found out that it was hard to find and keep track of all my things. This gave me the idea to make a Student Traveling Kit. I wanted everything to have its own special place. I also wanted a desk top for doing my homework because the tray tables on the airplane were too high for me to work comfortably. I also needed a place to work in the hotel.

SUMMARY OF THE INVENTION

My invention is a Student Traveling Kit comprising a sturdy carrying case having a first top compartment divided into two sections for homework and notebooks and a second bottom compartment divided into six sections for storing games, snacks, personal items and crayons and markers; a lightweight, washable plastic desk top attached to the carrying case with a duct tape hinge so that the desk top can be moved up or down and which when the desk top is in the down position covers the second compartment to make a working desk top; a handle attached to the outside of the carrying case for carrying the student traveling kit; and decorations on the outside of the carrying case to make the student traveling kit easy for the student to identify.

DESCRIPTION OF THE DRAWINGS

FIG. 3 is a side view of the Student Traveling Kit showing that the carrying case has a top compartment (30) and a bottom compartment (60) and the hinged desk top (10) which can be moved up to allow access to the compartment in the bottom of the carrying case or moved down to make a desk top for me to work on.

DETAILED DESCRIPTION OF THE INVENTION

Figure 1:
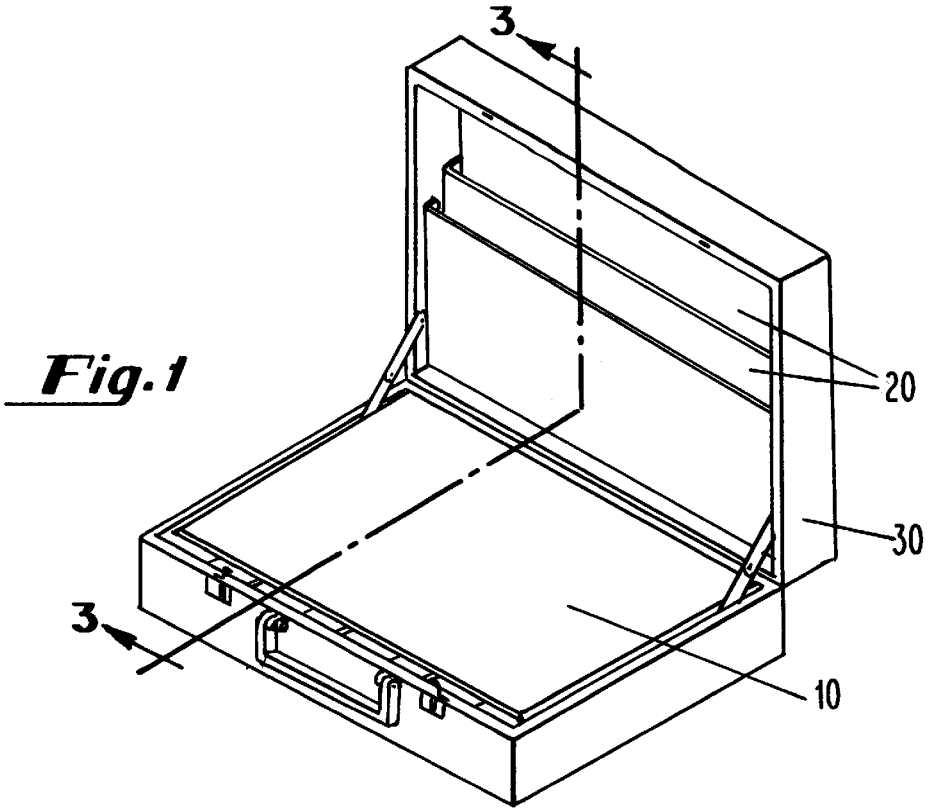
FIG. 1 shows the Student Traveling Kit in an open position with the desk top (10) in the usable position. Two sections for my homework assignments (20) are in the top compartment of the carrying case (30) and the plastic desk top (10) is shown in the down position covering the bottom compartment in the carrying case.
Figure 2:
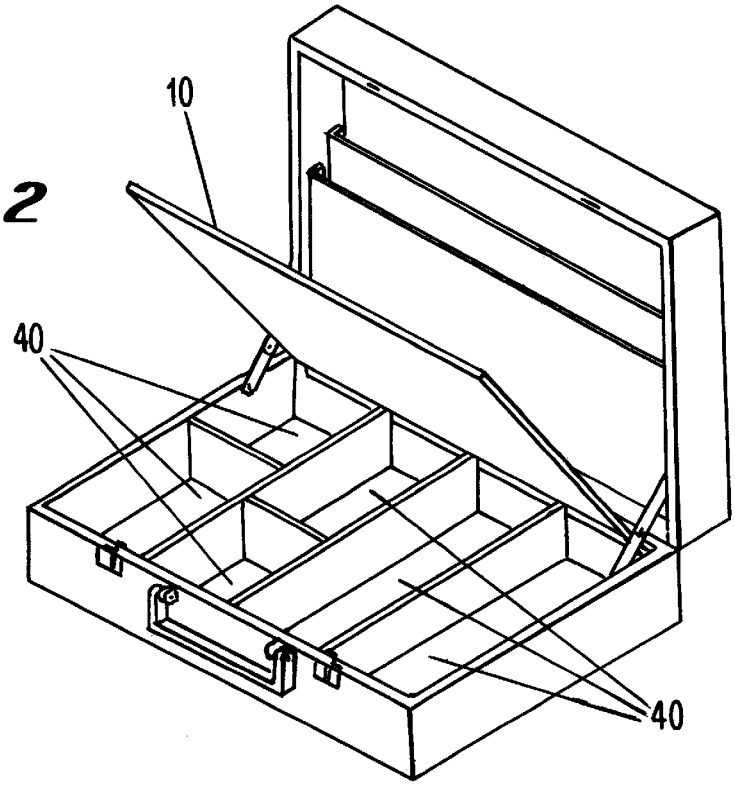
FIG. 2 shows the Student Traveling Kit in an open position with the desk top (10) lifted up so that the six sections (40) in the bottom compartment of the carrying case (60) for my snacks, games, crayons and markers and personal items can been seen.
Figure 3:
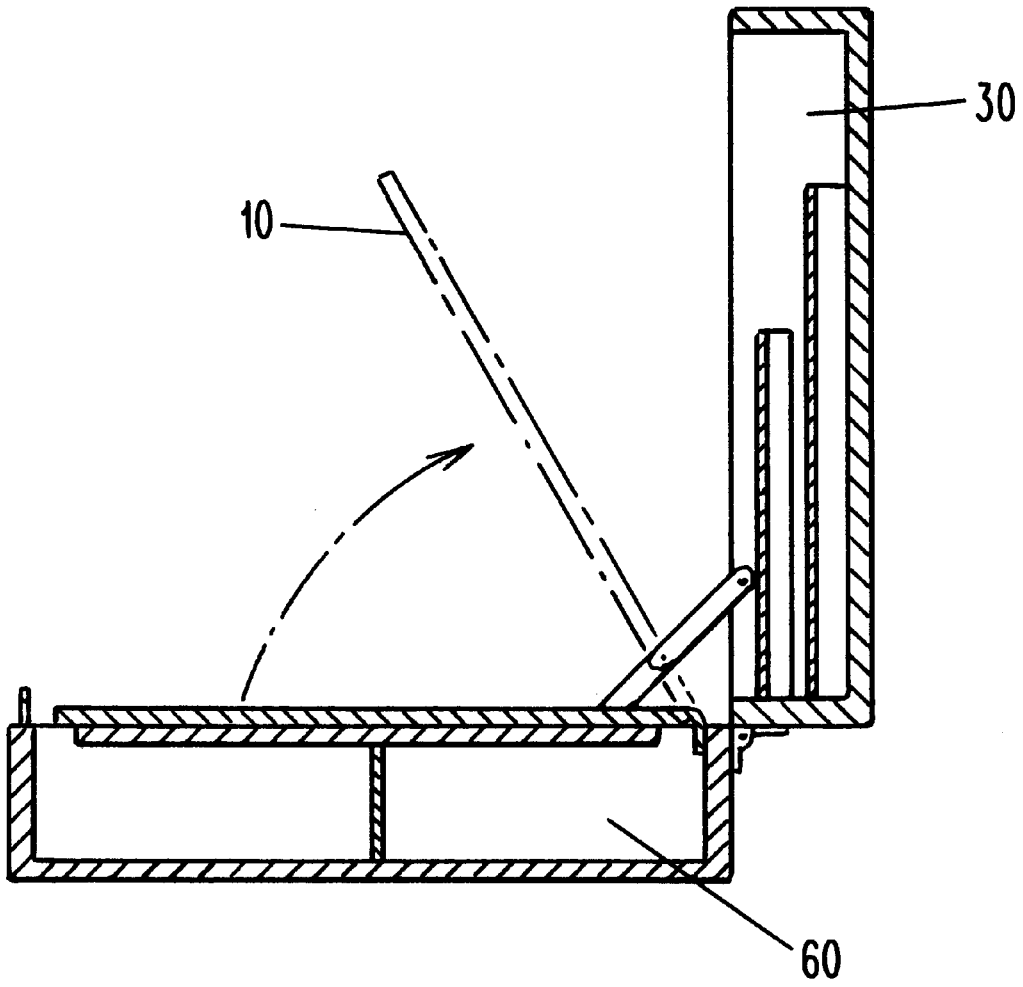

I talked to my mom and dad about my idea and they liked it. My dad took me to a garage sale and got me the right type of carrying case to make into the traveling kit. It needed to be very sturdy for traveling. It also had to be big enough to be a desk. It also needed to be able to be divided into different sections for storing homework, crayons and markers, pencils and pens, games, snacks and personal items. It also had to be a size I could carry myself. I decided on a nice old briefcase.

The first thing I did was decide what I was going to put in the kit and how to divide the inside of the carrying case. I needed a place for my homework, snacks, games and personal items like my brush and toothpaste and toothbrush, tissues and cozy socks. After thinking about ways to divide up the briefcase I decided to use paint stirrers as dividers. I measured the size needed and cut them to the right size with my Dad's help. Then my dad helped me glue them in because I am not allowed to use the hot glue gun by myself. It was hard to fit everything in the kit. After I put everything in and picked it up I found out I had a problem. The problem was that when I lifted it up everything fell out of place. To fix that problem I put a piece of rug over the things in the briefcase.

To make the desk, I found a piece of plastic that was the right size to fit in the briefcase. I picked plastic for the desk top because it is sturdy but light weight and because it is washable and easy to clean. My dad taught me how to make a hinge out of duct tape. I put a side of tape on the plastic board that was going to be the desk top and the other side of the duct tape on the briefcase. I tested it to see if it would stay and it worked.

When you are traveling, it is very important to be able to easily identify your belongings. Some people use tags that hang out. Some people write their name on the inside. Some people tie ribbons on the handle but I decided to put the identification on the outside front of the because I wanted it to be as easy as possible to identify my Student Traveling Kit. I decided to decorate the outside of the kit with stickers. I also added a few more items to my kit. After I looked at the whole kit, I wished I would have invented it before I went to Italy.

I claim:

1. A student traveling kit comprising a sturdy carrying case having a first top compartment consisting essentially of two sections sized for storing homework and notebooks and a second bottom compartment consisting essentially of six sections sized for storing games, snacks, personal items to keep the student neat, crayons and markers, and pens and pencils; a lightweight plastic desk top attached to the carrying case with a duct tape hinge so that the desk top can be moved up or down and which when the desk top is in the down position covers the bottom divided compartment to make a working desk top; an unattached piece of rug which rug fits over the second bottom compartment under the desk top so that the items stored in the bottom compartment sections stay in place; a handle attached to the outside of the carrying case for carrying the student traveling kit; and decorations on the outside of the carrying case to make the student traveling kit easy for the student to identify.

* * * * *